US010415940B2

(12) United States Patent
Sullivan et al.

(10) Patent No.: US 10,415,940 B2
(45) Date of Patent: Sep. 17, 2019

(54) OVER CENTER EXPANDING ARROWHEAD

(71) Applicants: Brian E. Sullivan, Alta Loma, CA (US); George Eurick, Buffalo Grove, IL (US)

(72) Inventors: Brian E. Sullivan, Alta Loma, CA (US); George Eurick, Buffalo Grove, IL (US)

( * ) Notice: Subject to any disclaimer, the term of this patent is extended or adjusted under 35 U.S.C. 154(b) by 0 days.

(21) Appl. No.: 16/031,750

(22) Filed: Jul. 10, 2018

(65) Prior Publication Data

US 2019/0033048 A1 Jan. 31, 2019

Related U.S. Application Data

(60) Provisional application No. 62/536,894, filed on Jul. 25, 2017.

(51) Int. Cl.
*F42B 6/08* (2006.01)
*F42B 12/34* (2006.01)

(52) U.S. Cl.
CPC ..... *F42B 12/34* (2013.01); *F42B 6/08* (2013.01)

(58) Field of Classification Search
CPC ..... F42B 6/08
See application file for complete search history.

(56) References Cited

U.S. PATENT DOCUMENTS 2,212,345 A 9/1938 Krieger
2,540,387 A 2/1951 Butler
2,568,417 A 9/1951 Steinbacher
2,859,970 A 6/1956 Doonan
3,759,519 A 9/1973 Palma
4,099,720 A 7/1978 Zeren
4,166,619 A * 9/1979 Bergmann ..... F42B 12/362 30/161
4,579,348 A 1/1986 Jones
4,615,529 A 10/1986 Vocal
4,642,929 A 2/1987 Franklin
4,973,060 A 11/1990 Herzing
4,998,738 A 3/1991 Puckett
5,066,021 A 11/1991 DeLucia
5,082,292 A 1/1992 Puckett et al.
5,083,798 A 1/1992 Massey
5,100,143 A 3/1992 Puckett
5,112,063 A 5/1992 Puckett
5,178,398 A 1/1993 Eddy
D342,303 S 12/1993 Johnson
5,286,035 A 2/1994 Ward
(Continued)

*Primary Examiner* — John A Ricci
(74) *Attorney, Agent, or Firm* — Kirk A. Buhler; Buhler & Associates Patenting

(57) ABSTRACT

Improvements in an expanding arrowhead where the initial launching thrust of launching an arrow keeps the blades retracted within the head of the arrow. The blades remain retracted because the center of mass of the blades is on the opposite side of the rotational pivoting axis of the blades. When the blades contact a target a wing tip on the blades pull the blades open. There are two or three blades that can be retained within the head of the arrow. The blades are loosely retained in a retracted orientation for transportation. The retention is sufficient to overcome the forces or gravity yet release with slight force on then ends of the blades. When the arrow is pulled through the wound track the blades fold back into the head or body.

20 Claims, 4 Drawing Sheets

(56) References Cited

U.S. PATENT DOCUMENTS

| | | | | |
|---|---|---|---|---|
| 5,458,341 | A * | 10/1995 | Forrest | F42B 6/08 473/583 |
| 5,472,213 | A | 12/1995 | Dudley | |
| 5,564,713 | A | 10/1996 | Mizek | |
| 5,803,845 | A | 9/1998 | Anderson | |
| 5,820,498 | A | 10/1998 | Maleski | |
| 5,857,930 | A * | 1/1999 | Troncoso | F42B 6/08 473/583 |
| 5,879,252 | A | 3/1999 | Johnson | |
| 5,941,784 | A | 8/1999 | Mizek | |
| 6,200,237 | B1 | 3/2001 | Barrie | |
| 6,258,000 | B1 | 7/2001 | Liechty | |
| 6,270,435 | B1 | 8/2001 | Sodaro | |
| 6,283,880 | B1 | 9/2001 | Barrie | |
| 6,398,676 | B1 * | 6/2002 | Mizek | F42B 6/08 473/583 |
| 6,428,434 | B1 | 8/2002 | Liechty | |
| 6,554,727 | B1 | 4/2003 | Armstrong et al. | |
| 6,595,881 | B1 | 7/2003 | Grace, Jr. et al. | |
| 6,626,776 | B2 | 9/2003 | Barrie et al. | |
| 6,669,586 | B2 | 12/2003 | Barrie et al. | |
| 6,830,523 | B1 | 12/2004 | Kuhn | |
| 6,910,979 | B2 | 6/2005 | Barrie et al. | |
| 6,935,976 | B1 | 8/2005 | Grace, Jr. et al. | |
| 7,377,869 | B2 * | 5/2008 | Wohlfeil | F42B 6/08 473/583 |
| 7,771,298 | B2 | 8/2010 | Pulkrabek | |
| 8,007,382 | B1 | 8/2011 | Sanford | |
| 8,043,177 | B2 | 10/2011 | Flanagan | |
| 8,105,187 | B1 | 1/2012 | Sanford | |
| 8,182,378 | B1 | 5/2012 | Futtere | |
| 8,197,367 | B2 | 6/2012 | Pulkrabek | |
| 8,210,970 | B1 | 7/2012 | Sanford | |
| 8,210,972 | B2 | 7/2012 | Adams et al. | |
| 9,372,056 | B2 * | 6/2016 | Sullivan | F42B 6/08 |
| 9,879,955 | B2 * | 1/2018 | Rowley | F42B 6/08 |
| 2001/0006916 | A1 | 7/2001 | Liechty, II | |
| 2001/0036876 | A1 | 10/2001 | Barrie et al. | |
| 2002/0065155 | A1 | 5/2002 | Liechty, II | |
| 2002/0098926 | A1 | 7/2002 | Liechty, II | |
| 2003/0004021 | A1 | 1/2003 | Barrie et al. | |
| 2003/0073525 | A1 | 4/2003 | Liechty, II | |
| 2003/0153417 | A1 | 8/2003 | Barrie et al. | |
| 2007/0161438 | A1 | 8/2007 | Fulton | |
| 2008/0102996 | A1 | 5/2008 | Erhard | |
| 2009/0111621 | A1 | 4/2009 | Mizek | |
| 2010/0273588 | A1 | 10/2010 | Pulkrabek | |
| 2012/0220400 | A1 | 8/2012 | Pulkrabek | |

* cited by examiner

OVER CENTER EXPANDING ARROWHEAD

CROSS REFERENCE TO RELATED APPLICATIONS

This application claims the benefit of Provisional Application Ser. No. 62/536,894 filed Jul. 25, 2018 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in an expanding arrowhead. More particularly, the present over center expanding arrowhead. Places the centroid of mass of expanding elements of the blades at a location that keeps the blades closed during acceleration and flight and when a tab makes contact with the target, the blades are drawn open.

Description of Related Art including information disclosed under 37 CFR 1.97 and 1.98.

In archery hunting it is desirable to pierce an animal with a broad head arrow that can quickly kill the animal and can leave a blood trail that can be tracked to locate the animal. Broadhead arrows create additional drag because of the broad tip of the arrowhead. Broadhead blades which are exposed during flight often result in undesirable steering of the front portion of the arrow, causing the arrow to deviate from a perfect flight path that coincides with a longitudinal axis of the arrow shaft, when loaded or drawn within an archery bow. Reducing the surface area of a broad head blade, the undesirable steering effects can be reduced. However, by reducing the surface area of a blade, the cutting area within a target or game is also reduced, resulting in a less effective entrance and exit wound.

Conventional blade-opening arrowheads have been designed so that a substantial portion of the blade is hidden within the body of the arrowhead, such as during flight of the arrow. Upon impact, such blades are designed to open and thereby expose a cutting surface or sharp edge of the blade. When the blades of such conventional arrowheads are closed and substantially hidden within the body, the exposed surface area is reduced and thus produces relatively less undesirable steering effects.

When an arrow is sent the shock of sending the arrow can inadvertently open an arrowhead. To maintain the blades in a closed position during flight, upon impact, such annular retaining rings are designed to sheer or roll back along the opening blades, in order to allow the blades to move to an open position. Quite often, such conventional annular retaining rings are prone to cracking, particularly when the elastomer material dries out. A number of patents and or publications have been made to address these issues. Exemplary examples of patents and or publication that try to address this/these problem(s) are identified and discussed below.

U.S. Pat. No. 5,066,021 issued Nov. 19, 1991 to Paul V. DeLicia discloses an arrow system where impact with the tip of the arrow initializes blade opening. The blades continue to open as the arrow enters into the animal. A glancing blow will not open the blades because they are not sufficiently exposed to make contact with the hide of the animal.

U.S. Pat. No. 5,083,798 issued Jan. 28, 1992 to Douglas J. Massey discloses an expanding broad head for an arrow. This patent uses an internal slug that moves forward upon impact to open the broad head. Forward inertial as the arrow is launched has no effect on the inertial slug.

U.S. Pat. No. 8,197,367 issued Jun. 12, 2012 to Larry R. Pulkrabek et al discloses an expandable broad head with rear deploying blades. The blades are retained in a slot and forces on the ends of the blades slide the blades into an open orientation. With this design, a glancing blow will not open the blades because they are not sufficiently exposed to make contact with the hide of the animal to slide one or both of the blades open.

Published U.S. Patent Application number 2003/0153417 that published on Aug. 14, 2003 to Bruce Barrie et al., discloses an expanding broad head. Upon impact or deceleration of the arrow the blades will translate backward to an exposed condition. While this patent discloses expanding blades, because the initial force required opening the blades can be high to prevent pre-mature opening as the arrow is initially launched.

U.S. Pat. No. 8,905,874 that issued on Dec. 9, 2014 and U.S. Pat. No. 9,372,056 that issued on Jun. 21, 2016, both to Brian Sullivan et al., are titled Broadhead Arrowhead with Two-Stage Expansion. These patents disclose an arrowhead that opens in two stages. This provides a broad head arrow that can be launched with a traditional or compound bow to allow a hunter to bring down large game in an efficient manner. When an arrow is launched the arrow receives a thrust of energy from the string that launches the arrow. The initial thrust partially opens the arrowhead in a first stage of opening to provide a low fight profile that reduces flight air resistance. A major problem with this design is that once the arrow enters the prey the cutting blades can't be retracted to remove the arrow, or for the animal to dislodge the arrow if it is not killed.

What is needed is an over center expanding arrowhead where the force of the launch does not open the arrowhead, but the arrowhead opens upon impact. The arrowhead should remain closed without the need of a sacrificial element. The proposed over center expanding arrowhead provides the solution by placing the centroid of rotation for the blades over the center of the direction of travel.

BRIEF SUMMARY OF THE INVENTION

It is an object of the over center expanding arrowhead to place the center of rotation of the blades in a location that momentum and inertial travel forces the blades to remain in a closed orientation. The initial launch of an arrow produces high forces on moving components of an arrow. The forces will cause components to rotate based upon the location of the rotational center of mass about a pivoting axis. Proper location of the center of mass can force the blades of the arrowhead to open or close upon launch.

It is an object of the over center expanding arrowhead for the blades to be temporally retained in the closed orientation. This is accomplished with a spring, elastomeric or a magnet. The spring, elastomeric member or magnet keeps the blades in a tucked or close orientation while a user handles the arrow. The retention is sufficient to overcome the forces or gravity on the blades as the arrow is being handled, and also allows the blades to easily open with slight force on the ends of the blades to open with the arrow contacts a target.

It is an object of the over center expanding arrowhead for the blades to minimize air resistance while the arrow is in flight. Minimizing the cross-sectional area of the arrow that moves through the air reduces air resistance and drag that can slow the speed of the arrow and effects the distance the arrow can travel and the velocity of impact as the arrow reaches a target.

It is another object of the over center expanding arrowhead for the cutting blades to fold into the body of the arrowhead as the arrow is withdrawn through the wound path. If the arrowhead remains expanded it is difficult to remove from an animal and must be cut or pushed through the animal thereby damaging part of the usable meat. Another problem is that if the animal is not killed, the animal can't rub the arrow out. If the blades retract when the arrow is pulled through the wound path minimal damage occurs to the meat and a wounded animal may be able to remove the arrow and heal.

It is another object of the over center expanding arrowhead for the cutting blade to pass through the body of the arrow head. Because the center of rotational is over the center of the arrow the blade also exists over the rotational center of the arrow. When the blade opens the cutting blade is rotated through the center of the shaft axis, in a two-blade version, where the blade then exists of the opposite side of the shaft axis as the blade enters the target. In a three-blade version the cutting blade are arranged 120 degrees around the shaft and rotate along the side of the shaft.

It is still another object of the over center expanding arrowhead for the cutting blade to open upon impact with a target. The opening tips of the arrow pivot through the body of the shaft. Slight pressure on the tips will pull the blade open to expose the blade where it can enter the target.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
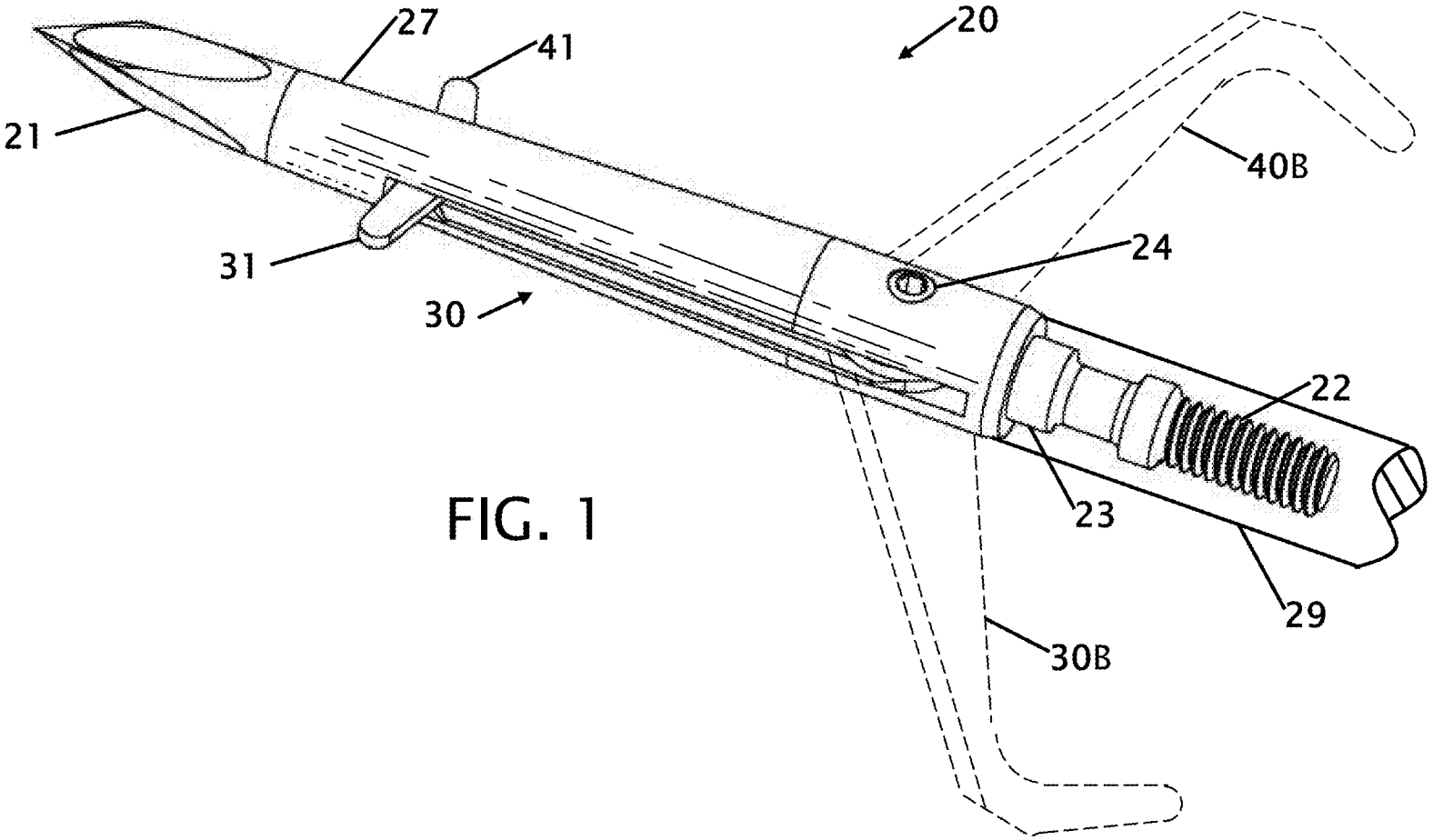
FIG. 1 shows a perspective view of an over center expanding arrowhead.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

ITEM NUMBERS AND DESCRIPTION

17 central axis
18 wound path
19 target
20 over center expanding arrowhead
21 tip
22 threads, threaded
23 shank
24 fastener
25 shaft of fastener
26 tip
27 body
28 stop(s)
29 shaft
30 blade
30B dashed line
31 tip
32 pivoting axis
33 rotational mass
34 sharpened side
35 radius
36 displacement
40 blade
40B dashed line
41 tip
42 axis
43 center of rotation
44 cutting edge
45 slight radius
46 stops
47 stop
57 force
58 ball
59 spring
90 launched
90B inertia
91 rotate
92 force
93 open
94 pulling
95 rotate FIG. 1 shows a perspective view of an over center expanding arrowhead 20. In this view, the blades 30 and 40 (not shown) are shown in solid lines retracted in the body 27 of the head and as dashed lines 30B and 40B in the open orientation. The blades 30 and 40 pivot through an axis that is defined by a fastener 24. The fastener is preferably a shoulder bolt but can take other forms. The body 27 of the over center expanding arrowhead 20 includes a shank 23 with a shoulder and threads 22 that secures the over center expanding arrowhead 20 to the shaft 29 of an arrow.

Each blade 30 and 40 has a tip 31 and 41 respectively that extends from the body 27 of the over center expanding arrowhead 20 while the remainder of the blades remain nested within the body. The tip 21 of the over center expanding arrowhead 20 is pointed to provide initial penetration of the over center expanding arrowhead 20 into the target. The tips 31 and 41 are arranged to make contact with a target and pull the blades 30 and 40 out of the body 27. While this figure shows two blades it is contemplated that the arrowhead can have three of four blades that fold into or across the body of the arrowhead.

Figure 2:
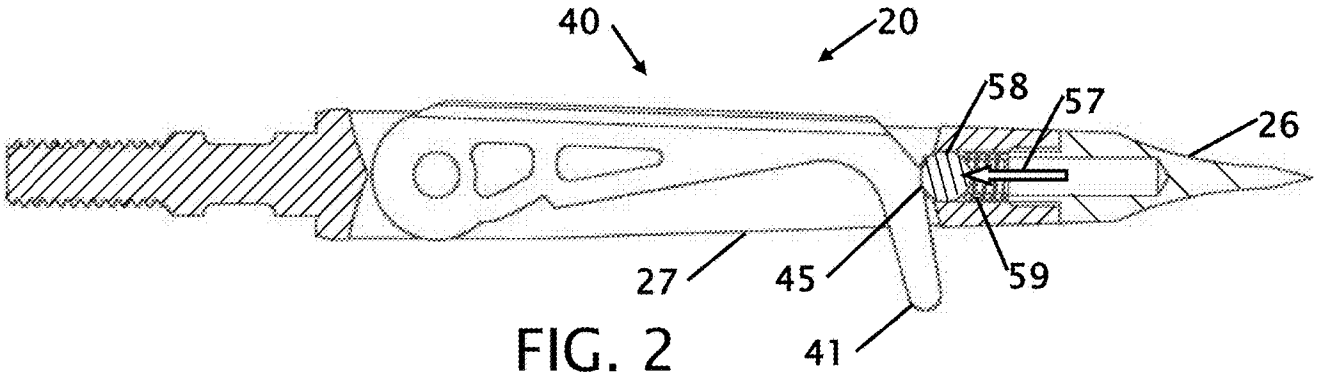
FIG. 2 shows a sectional view of the over center expanding arrowhead.

FIG. 2 shows a sectional view of the over center expanding arrowhead. In this figure only one blade 40 is shown with the body 27 of the over center expanding arrowhead 20. The blades can freely rotate through the majority of their travel. To minimize injury for storage and transportation the blades are tucked in the body 27 of the over center expanding arrowhead 20. To keep the blades within the body 27 the blades are retained with a spring 59 loaded ball bearing 58. A slight radius 45 is placed in leading edge of the tip 41 of the blade 40. The spring 59 is selected to provide the desired force 57 of the ball 58 to hold the blade 40 in the retracted position. The force 57 of the spring 59 is selected to provide a minimal force that is easily overcome when force is placed in the blade tip 41. A user can easily overcome the force 57 and pull the blade 40 out of the body and also push the blade back into the engagement with the ball 58 retention.

Figure 3:
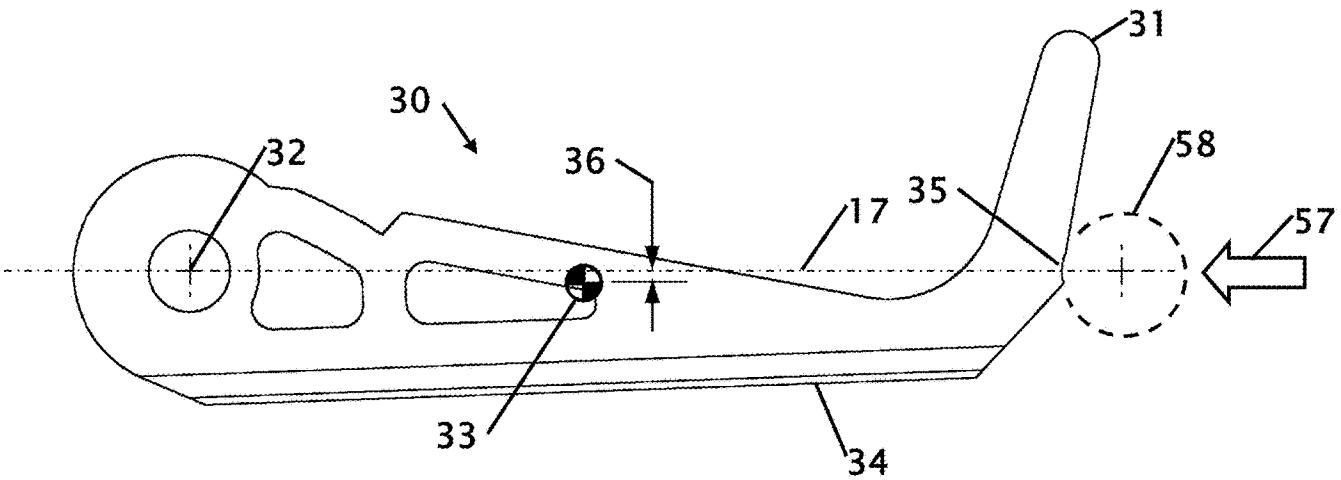
FIG. 3 shows a single blade and the blade retention mechanism.

FIG. 3 shows a single blade 30 and the blade retention mechanism. The blade 30 is designed with the majority of the mass of the blade 30 is placed on a particular side of the pivoting axis 32 of the blade. This figure shows the central axis 17 of the arrow passing through the pivoting axis 32 of the blade 30. The blade has a sharpened side 34 that cuts through the target. The rotational mass 33 is shown in this figure with the displacement 36 from the centerline 17 of the arrow.

The blades are held within the body 27 the blades are retained with a spring-loaded ball bearing 58. A slight radius 35 is placed in leading edge of the tip 31 of the blade 30. This arrangement of the ball 58 in the cradle radius 35 allows a user to easily open and close the blade 30 from the arrowhead for inspection. While a spring-loaded bearing is shown and described it is further contemplated that the retention mechanism can be a magnet, elastomeric, friction fit or other mechanism.

Figure 4:
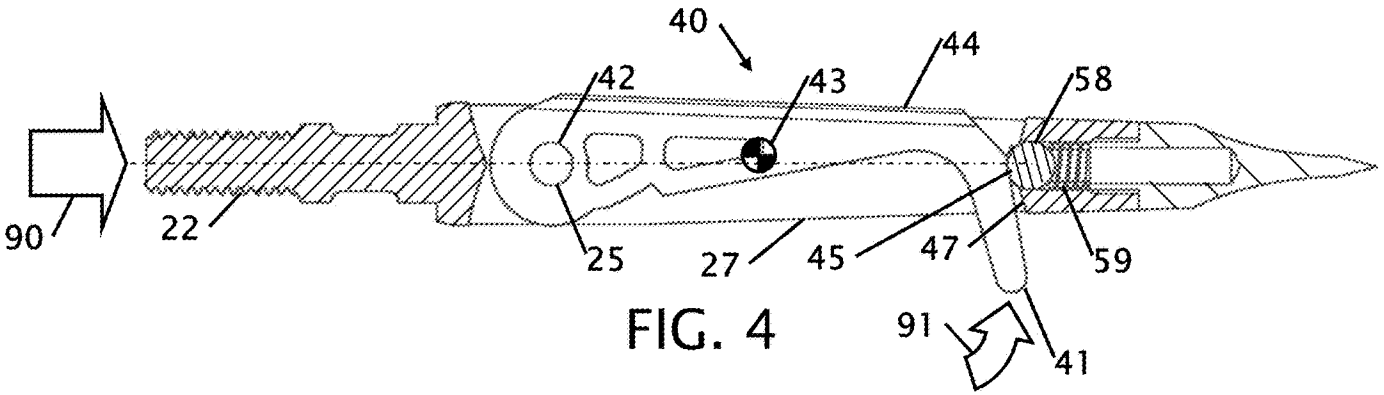
FIG. 4 shows the over center mechanism at an arrow launch.

FIG. 4 shows the over center mechanism at an arrow launch. As previously described, the spring 59 keeps the ball in a recess of the blade 40. The arrowhead is threaded 22 onto the shaft of an arrow. When the arrow is launched 90 a high force of acceleration is placed in the arrowhead. The forward inertial force will make the blade 40 rotate 91 from the pivot axis point that is retained by the shaft of the fastener 25 towards the center of rotation 43. The launch forces the blade 40 to close within the body 27 of the arrowhead. The thrust of the launch 90 can cause the blade 40 to rotate the tip 41 into a hard stop 47 in the front of the body of the arrowhead. This will actually assist in keeping the blade closed during travel. The deceleration of the arrow as it travels may produce some forces to open the blade and air resistance on the tip 41 may further produce some opening of the blade 40, but these forces are overcome by proper selection of the ball 58 and the spring 59 to hold the ball 58 in the previously described slight radius 45 detents on the blade 40.

Figure 5:
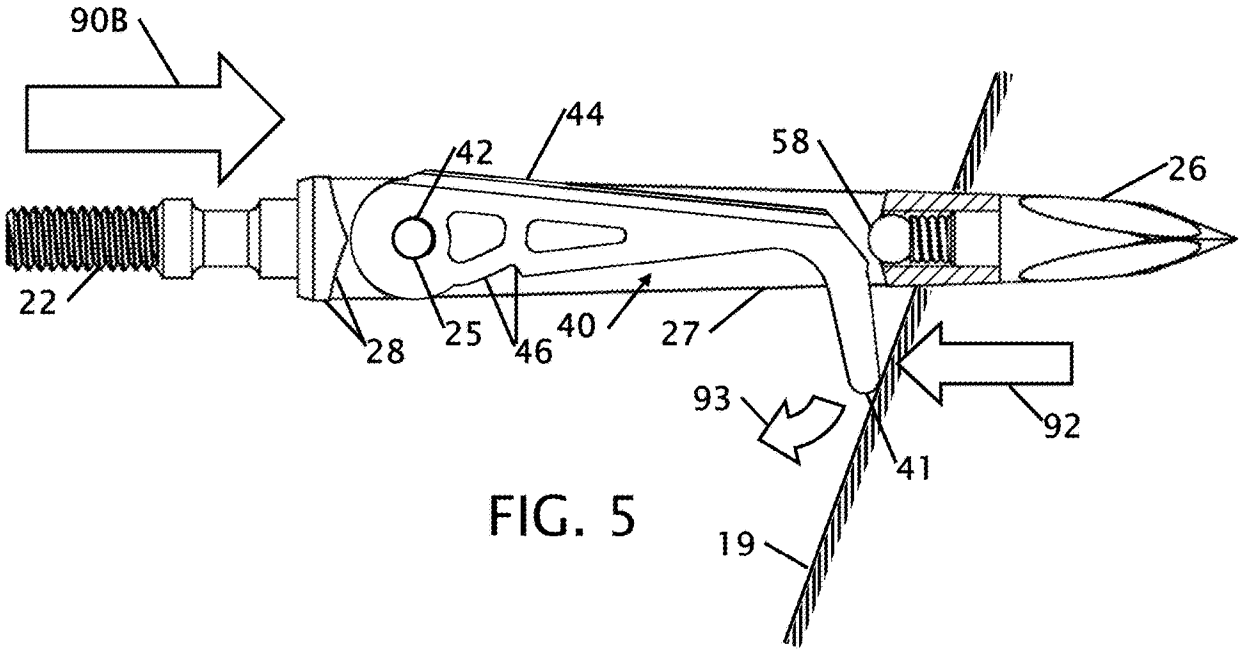
FIG. 5 shows the blade opening as it enters a target.

FIG. 5 shows the blade 40 opening as it enters a target 19. The inertia 90B of the arrow will drive the over center expanding arrowhead 20 into the target. As the over center expanding arrowhead 20 enters the target 19 the tip 26 will initially penetrate. As the arrow continues into the target, the tip 41 will make contact with the target 19. The force 92 on the tip 41 will overcome the forces of the ball 58 in the detent of the blade 40. This force 92 will rotate the blade 40 open 93 as the blade 40 pivots through axis 42 on the shaft of the fastener 25 or bearing. As the blade 40 opens the cutting edge 44 passes through the body 27 of the arrowhead to the opposite side of the center of the arrowhead body.

The blade 40 will continue to rotate until the stop(s) 46 of the blade 40 make contact with the stop(s) 28 in the rear portion of the arrowhead body 27. With the blades open the over center expanding arrowhead 20 will continue into the target and cut a wound path.

Figure 6:
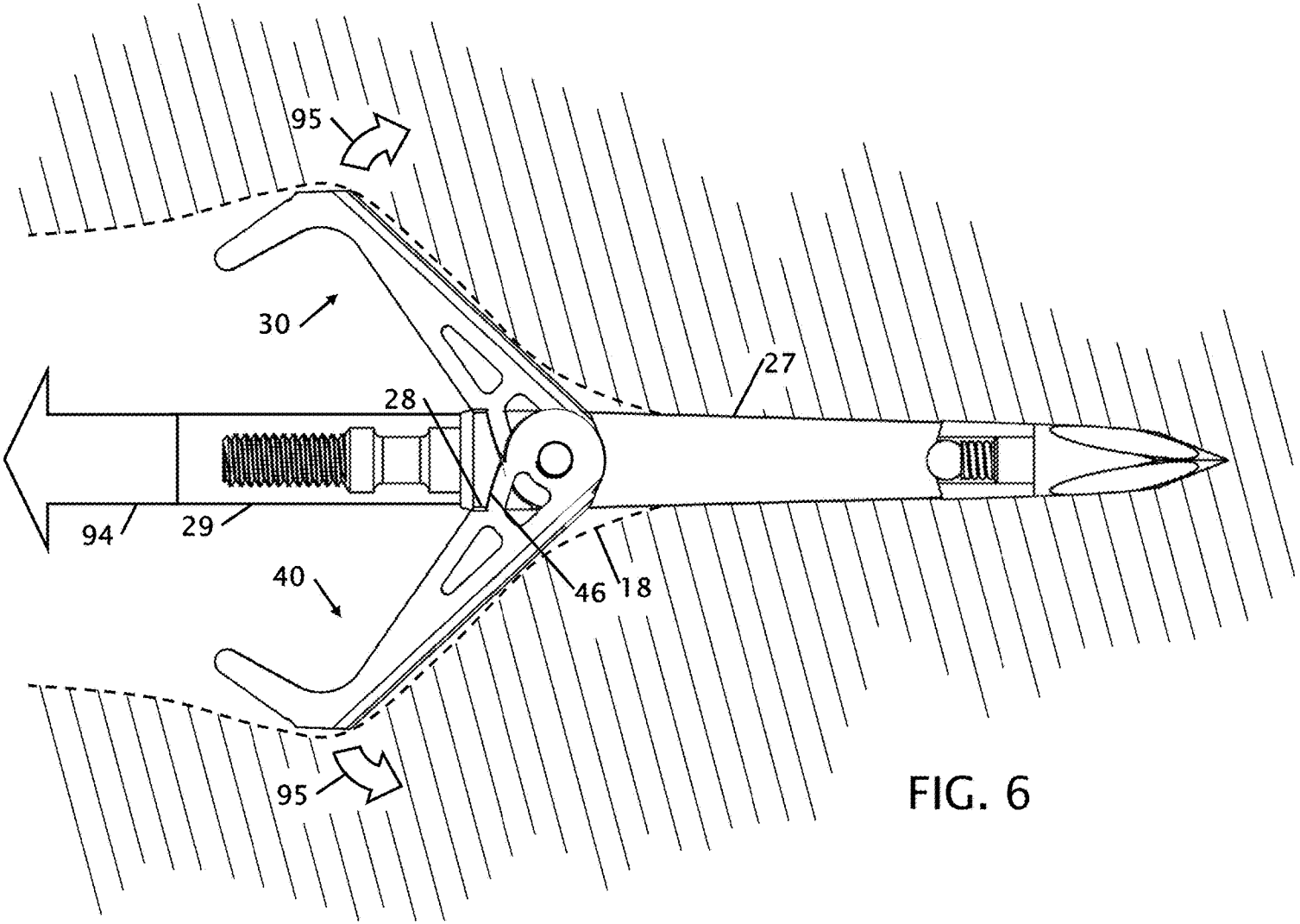
FIG. 6 shows the arrow in a target and removal of the arrow through the wound path.

FIG. 6 shows the arrow in a target and removal of the arrow through the wound path 18. In this figure both blades 30 and 40 are open and have cut a wound path 18. The stops 46 on the blade(s) are in contact with the stops 28 in the arrowhead body 27 to prevent further rotation of the blades.

Once the arrow is within the target, the arrow can be withdrawn by pulling 94 on the shaft 29. The pulling force 94 will cause the blades 30 and 40 to rotate 95 into the closed orientation where the arrow can be withdrawn through the wound path. If an animal is not mortally wounded the animal can rub the arrow out of the wound path.

Thus, specific embodiments of an over center expanding arrowhead have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An over center expanding arrowhead comprising:
- a body having a slot passing through said body;
- said body having a central axis;
- a pivot passing through said body and said pivot retains at least two blades;
- each of said at least two blades having a centroid of mass;
- each of said blades have a sharp side located a first elongated side of said centroid of mass;
- each of said at least blades have a tip that extends out of said body and exist on a second elongated side of said centroid of mass from said central pivot axis, and
- forces on said tip towards said pivot rotates said blade whereby all of said sharp side passes through said central axis of said body to an open orientation.

2. The over center expanding arrowhead according to claim 1, further includes a spring-loaded bearing that temporally retains said blades in a closed orientation.

3. The over center expanding arrowhead according to claim 1, wherein said tip has a rotational stop.

4. The over center expanding arrowhead according to claim 3, wherein said stop limits rotation of each of said at least two blades.

5. The over center expanding arrowhead according to claim 1, wherein force from launching said arrow imparts a closing force or direction to said at least two blades into a closed orientation.

6. The over center expanding arrowhead according to claim 1, wherein said at least two blades rotate into said body when said arrow is pulled through a wound path.

7. The over center expanding arrowhead according to claim 1, wherein said centroid of mass passes through said central pivot axis when said blade opens.

8. The over center expanding arrowhead according to claim 1, wherein said centroid of mass is on a first side of said central pivot axis.

9. The over center expanding arrowhead according to claim 1, wherein each of said at least two blades have a radius depression on an end that is opposite of said central pivot axis.

10. The over center expanding arrowhead according to claim 9, further includes a ball that locates within said radius depression.

11. The over center expanding arrowhead according to claim 10, wherein said ball is biased with a spring.

12. The over center expanding arrowhead according to claim 11, wherein said ball and said spring are centered in said arrowhead body.

13. The over center expanding arrowhead according to claim 12, wherein said forces on said tip overcomes forces of said spring.

14. The over center expanding arrowhead according to claim 1, wherein entry of said arrowhead in a target opens at least one of said at least two blades.

15. An over center expanding arrowhead comprising:

a body having a slot passing through said body;

said body having a central axis;

a pivot passing through said body and said pivot retaining at least two blades;

each of said at least two blades has a centroid of mass on a first side of said central axis;

each of said at least blades have a first elongated side that is stored within said body when said arrowhead is launched and a second elongated side with a tip that extends out of said body;

each of said at least two blades are temporally retained in at least some of said body with a retention spring, and forces on said tip overcomes a force of said retention spring and rotates each of said blades so said centroid of mass passes to a second side of said central axis to open said at least two blades out of said body.

16. The over center expanding arrowhead according to claim 15, each of said at least two blades has a stop.

17. The over center expanding arrowhead according to claim 16, wherein said stop limits rotation of each of said at least to blades.

18. The over center expanding arrowhead according to claim 15, each of said at least two blades have a radius depression near said tip.

19. The over center expanding arrowhead according to claim 18, further includes a ball that is pressed by said spring to locates said ball within said radius depression.

20. The over center expanding arrowhead according to claim 15, wherein entry of said arrowhead in a target opens at least one of said at least two blades.

* * * * *